United States Patent [19]

Watterson

[11] Patent Number: 4,921,242

[45] Date of Patent: May 1, 1990

[54] EXERCISE APPARATUS RESISTANCE SYSTEM

[75] Inventor: Scott R. Watterson, River Heights, Utah

[73] Assignee: Weslo, Inc., Logan, Utah

[21] Appl. No.: 221,516

[22] Filed: Jul. 20, 1988

[51] Int. Cl.[5] ..... A63B 21/02; A63B 69/06

[52] U.S. Cl. ..... 272/72; 272/136

[58] Field of Search ..... 272/72, 137, 142, 136, 272/DIG. 4, 116, 138, 139, 140, 141, 143, 135

[56] References Cited

U.S. PATENT DOCUMENTS

| | | | |
|---|---|---|---|
| 1,866,868 | 7/1932 | Thompson et al. | 272/72 |
| 2,128,332 | 8/1938 | Schollmeyer | 272/72 |
| 2,131,570 | 9/1938 | Riley | 272/72 |
| 4,521,013 | 6/1985 | Dofel | 272/142 |
| 4,537,396 | 8/1985 | Hooper | 272/72 |
| 4,645,197 | 2/1987 | McFee | 272/142 |
| 4,645,204 | 2/1987 | Berger | 272/137 |
| 4,685,670 | 8/1987 | Zinkin | 272/142 |
| 4,736,944 | 4/1988 | Johnson | 272/72 |
| 4,796,881 | 1/1989 | Watterson | 272/72 |

FOREIGN PATENT DOCUMENTS

| | | | |
|---|---|---|---|
| 1177502 | 11/1984 | Canada | 272/72 |

*Primary Examiner*—Stephen R. Crow

*Attorney, Agent, or Firm*—Trask, Britt & Rossa

[57] ABSTRACT

An exercise machine such as a rowing machine has a resistance system which consists of a fluid cylinder interconnected at one end to the movable block of a block and tackle which is selected to have a desired mechanical advantage to provide the desired resistance to movement of machine operation means such as the handle of the rowing machine. Adjustment structure provides for variable or adjustable resistance to movement of the block and tackle structure.

21 Claims, 2 Drawing Sheets

EXERCISE APPARATUS RESISTANCE SYSTEM

BACKGROUND OF THE INVENTION

1. Field:

This invention relates to apparatus for use in performing exercises. More particularly, this invention discloses a resistance system for use with exercise machines including rowing exercise machines.

2. State of the Art:

Exercise machines (e.g., rowing machines, lift machines, multi-gyms) in wide spread use today typically employ some type of structure to surmountably resist movement so that the user exercises various muscle groups in attempting to overcome the resistance. For example, the GYMPAK™, manufactured by Diversified Products Corporation of Opelika, Ala., has a handle connected via an elevated pulley to ground level weights which are selected by the user as a resistance to be overcome by the user. U.S. Pat. No. 4,477,071 shows a rowing exercise machine in which a pair of hydraulic cylinders are used to provide resistance to movement of levers by the arms of a user.

As noted above, the resistance systems for these exercise machines frequently rely upon gravity acting upon selectable weights to provide variable resistance and upon hydraulic cylinders or springs in which a variable or adjustable lever dimension is employed such to vary the resistance as that shown in U.S. Pat. No. 4,477,071. Systems using selectable weights inevitably require some type of strong support structure to support the weight and space to allow movement through a distance. Further, the static weight inhibits widespread use of the machine which must be carefully placed to ensure that its support surface will not be damaged and is sufficiently strong to support the overall weight of the machine.

From another perspective, machines of the type shown in U.S. Pat. No. 4,477,071 typically employ two arms and two cylinders which are duplicative and in turn costly. Such arrangements require some volume for shipping and for storage. Similarly, machines employing weights are typically bulky and require some volume for shipping and storage. For both hydraulic and gravity-weight systems, adjustment of the resistance can be effected but generally only by stopping the exercise to adjust the resistance (e.g., change lever arm length and/or add/subtract weight). In systems involving multiple handles, resistance can be difficult to adjust.

A resistance system for machines is needed which is reliable and which involves use of compact resistance means but which is lightweight and easy to adjust preferably while in use.

SUMMARY OF THE INVENTION

A resistance system for exercise machines has a frame and operation means mechanically associated with the frame for operation by the user to perform exercises. The resistance system includes a resistance means and a block and tackle means. The resistance means is mechanically associable to the frame of the exercise machine to provide resistance to movement of the operation means. The resistance means has a first end securable to the frame and a second end. The block and tackle means are interconnected to operate the resistance means. The block and tackle means has a first block adapted to the second end of the resistance means and a second block interconnected to the first block by line to obtain a mechanical advantage. The line has a lead extending either from the first or the second block for interconnection to the operation means for movement of the first block and in turn the resistance means by operation of the operation means.

In a preferred embodiment, the resistance system includes return means operatively associated with the first block to urge the first block away from the second block. Desirably, the resistance system includes means for adjusting the resistance to movement of the first block. In a preferred embodiment, the resistance means is a fluid cylinder having a housing and a movable piston rod extending outward therefrom. The fluid cylinder preferably is of the type in which the force to move the piston rod outwardly therefrom varies at a preselected rate. The adjustment means is desirably a collar structure to adjust the piston rod outwardly from the housing.

In a preferred arrangement, the first and second block are positioned to be in general axial alignment. The first block desirably includes trolley means to maintain the first block in general axial alignment during movement of the first block. The first and second blocks are preferably multi-track pulleys, and the tackle is multiple line lacing.

In a highly preferred embodiment, the resistance system of the invention is incorporated into a rowing machine.

BRIEF DESCRIPTION OF THE DRAWINGS

In the drawings which illustrate the best mode presently contemplated for carrying out the invention.

DESCRIPTION OF THE ILLUSTRATED EMBODIMENT

Figure 1:
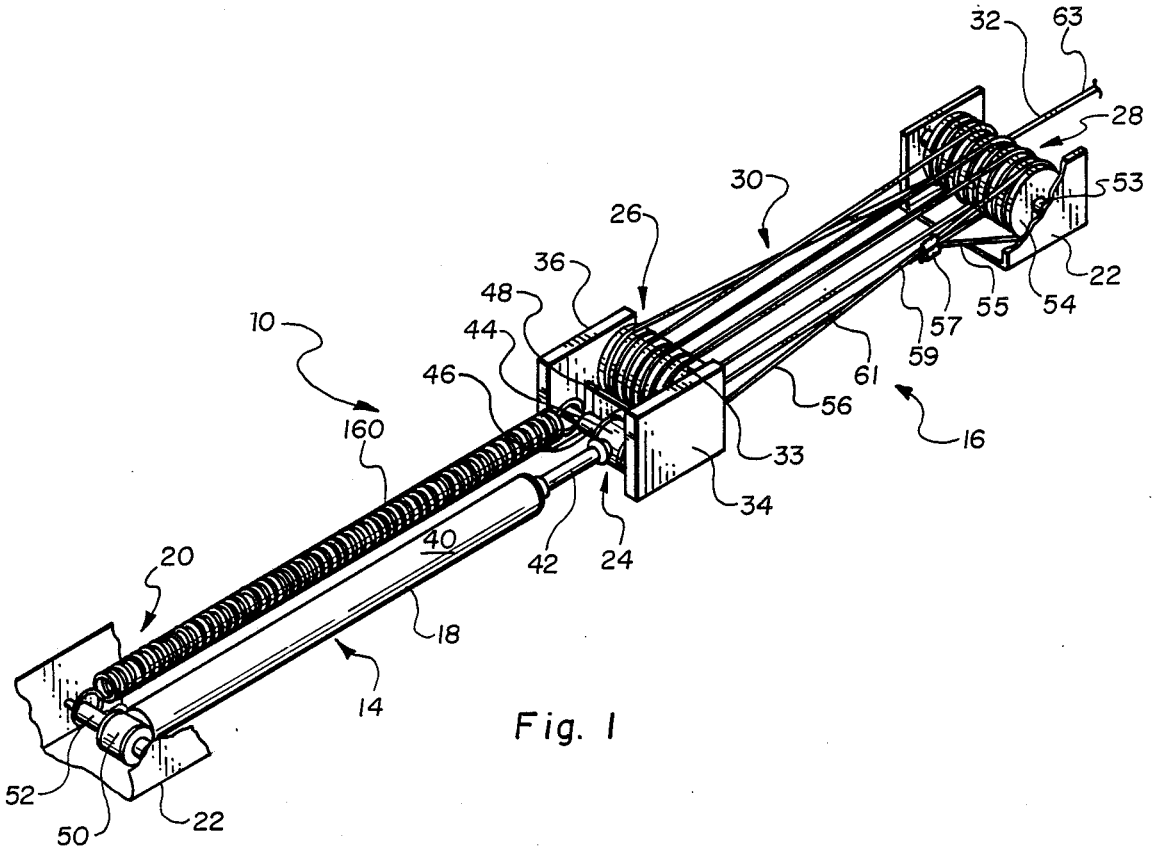
FIG. 1 is a perspective view of a resistance system of the instant invention.

FIG. 1 illustrates a resistance system of the invention generally indicated by the number 10. The system 10 is shown assembled for incorporation into a rowing machine 12 of the type illustrated in FIG. 2. The resistance system 10 includes resistance means 14 and block and tackle means 16. The resistance means 14 is here shown to be a hydraulic cylinder 18 which has a first end 20 secured to the frame means 22 of an exercise machine such as a rowing machine 12 shown in FIG. 2. The resistance means 14, and more particularly the hydraulic cylinder 18, has a second end 24 which is adapted to the first block 26 of the block and tackle means 16. Block and tackle means 16 also includes a second block 28 which is interconnected to the first block 26 by rope or line 30 to obtain a mechanical advantage. The second block 28 is also secured to the frame 22.

The rope or line 30 is here referred to as lacing and not tackle. Thus, it should be clearly understood that the term lacing 30 refers to the line 30 or rope trained about and interconnecting the two blocks 26 and 28 to provide a mechanical advantage for operating the resistance means 14. The lacing has a lead 32 which extends either from the first 26 or second 28 block for interconnection to the operation means of an exercise machine.

In FIG. 1, it can be seen that as the lead 32 is pulled outwardly (e.g., away from block 28), the first block 26 moves relative to the second block 28, which movement is resisted by the resistance means 14, and more particularly the hydraulic cylinder 18. Thus, upon interconnection to an exercise machine, surmountable resistance is made available merely by interconnection to the lead 32 by whatever operation means is desired.

As seen in FIG. 1, the first block 26 consists of a plurality of sheaves or pulleys 33 proximately mounted to each other on a central axle (not shown) which is further mounted to a pair of trolleys 34 and 36. As seen, the second end 24 of the resistance means 14, and more particularly of the hydraulic cylinder 18, is secured to the trolleys 34 and 36. As specifically shown, the hydraulic cylinder 18 has a housing 40 and a piston rod 42 with a sleeve 44 at its distal end. The sleeve 44 is sized to snugly but movably receive and adapted to fit about shaft 46 interconnected between trolleys 34 and 36. Additional reinforcement to hold the trolleys 34 and 36 may be provided by rod or brace 48 which may be secured between trolleys 34 and 36 by any acceptable means including nuts, bolts, welding, or the like. At the first end 20 of the resistance means 14, and more particularly of the hydraulic cylinder 18, another sleeve member 50 is adapted to the housing 40, which in turn is sized to snugly and movably receive the shaft 52 which is interconnected to the frame 22.

As noted before, the second block 28 is mounted to the frame 22 of an exercise machine by shaft 53. As here shown, the first block 26 has the same number of pulleys or sheaves 54 as the second block 28. The lacing 30 is comprised of a line 56 trained about the pulleys 33 and 56. As seen in FIG. 1, the inner bitter end 55 of line 56 is trained about one of the pulleys 54 and secured by a clip 57 to the bight 59 of the first leg 61 of the line 56. Although the end 55 is secured about a pulley, it should be understood that it could also be secured about axle 53 or to the frame 22 as desired. The line 56 is then trained about the pulleys 33 and 54 between the first block 26 and the second block 28 in a conventional fashion to provide the desired mechanical advantage. That is, the number of pulleys 33 and 54 or the number of legs such as leg 61 between the first 26 and the second 28 block result in a desired mechanical advantage as well known to those skilled in the art. End 63 of line 56 is led away either from the first block 26 or the second block 28 as lead 32 for further interconnection to the operation means of an exercise machine.

It should be understood that the cylinder 18 may be any fluid cylinder. Desirably it is a hydraulic cylinder of the type in which the force to move the piston rod outwardly varies at a preselected rate as the piston rod is moved outwardly from the housing. In most applications, the force to move is selected to increase. The cylinder illustrated 18 is similar to a shock absorber in construction and configured to provide a high degree of resistance to be overcome by the mechanical advantage available from the block and tackle.

As can further be seen in FIG. 1, the pulleys 33 of the first block 26 rotate about an axis 29 and the pulleys 54 of the second block 28 rotate about an axis 31 which axis 31 is shown substantially parallel to the axis 29. Also the block and tackle 16 may be said to have a longitudinal axis 27. The longitudinal axis 25 of the cylinder 18 is shown coaxial with the axis 27.

Figure 2:
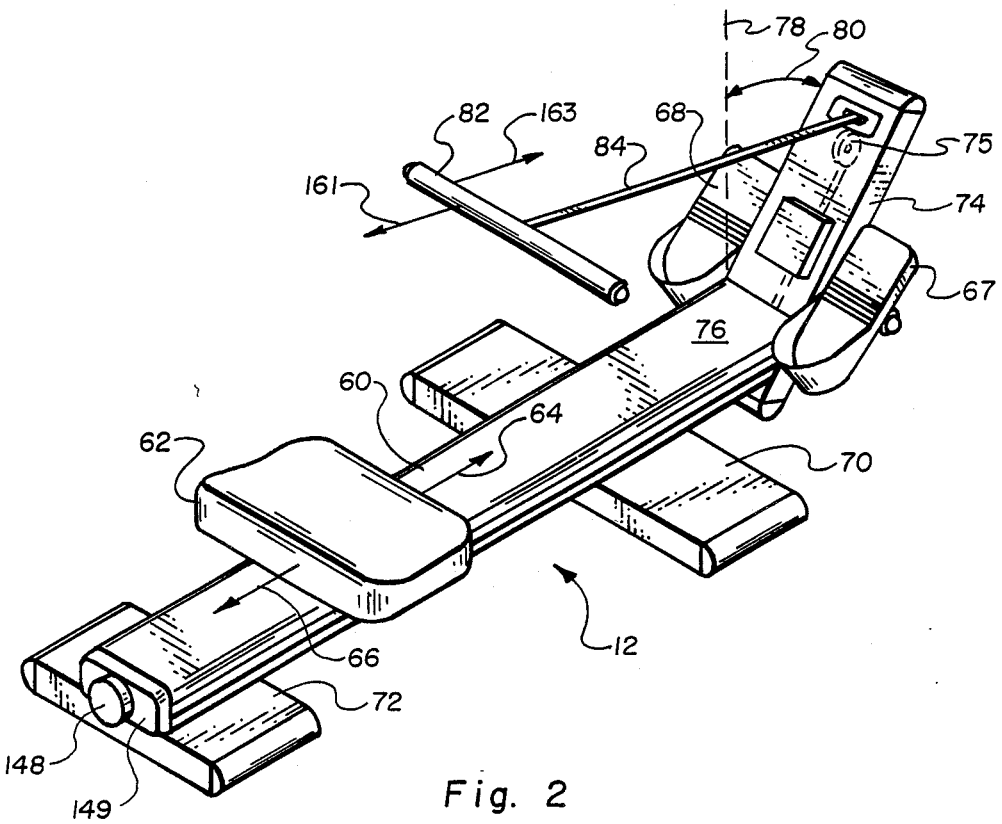
FIG. 2 is an illustration of a rowing machine incorporating a resistance system of the instant invention.

Referring to FIG. 2, a rowing machine 12 is shown having a track means 60 with a seat 62 slidably adapted thereto for movement forward 64 and rearward 66 by ,the user having his or her feet positioned on foot support means 67 and 68. The track means 60 is adapted to support means 70 and 72 to support the track means 60 on an appropriate support surface such as a floor. An upwardly extending member 74 is positioned at the foot end 76 of the track means 60 as here shown to extend upwardly and generally away from the track means 60. The member 74 may angle from the vertical 78 at an angle 80 from about 15 to about 40 degrees and preferably about 30 degrees.

The rowing machine 12 of FIG. 2 also includes a handle 82 which is connected to a cable 84 which is trained through the member 74 about pulley 75 down to the track means 60. A resistance system such as the system 10 of FIG. 1 is adapted to the track means 60 to be therewithin, with the cable 84, handle 82 and member 74 acting as operation means interconnected to the lead 32 of the resistance means 10.

Figure 3:
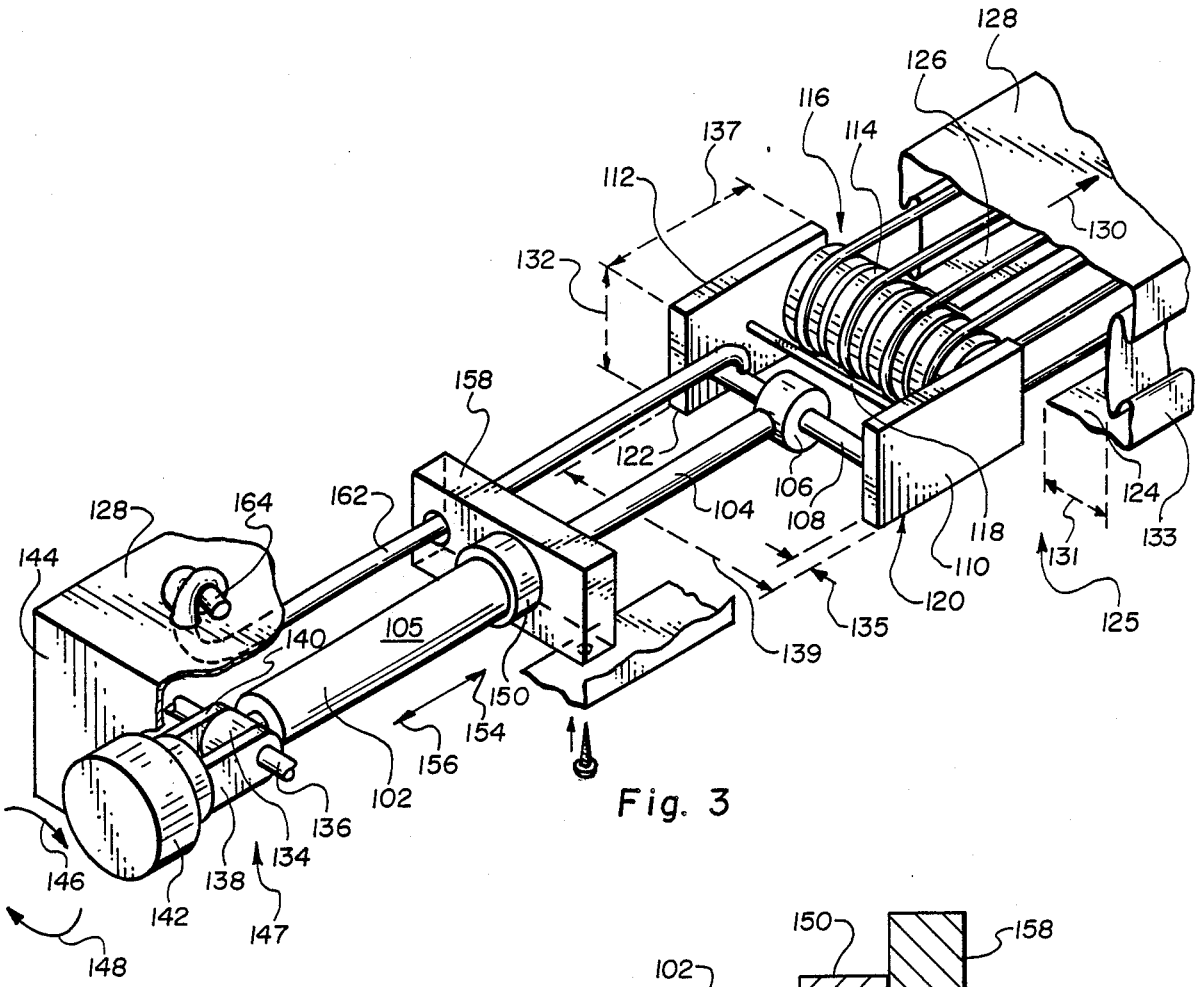
FIG. 3 is a partial perspective view of a resistance system of the instant invention incorporating adjustment means with cut-away portion of the exercise machine.

In an alternate embodiment seen in FIG. 3. the resistance means includes a hydraulic cylinder 102 having a piston rod shaft 104 extending from a housing 105. A sleeve mechanism 106 is adapted to the piston rod 104 to be the second end of the resistance means. The sleeve mechanism 106 is adapted to an axle 108 which is interconnected between the two trolleys 110 and 112. The pulleys or sheaves 114 of the first block 116 are interconnected between the trolleys 110 and 112 and rotate about a pulley axle (not shown) adapted between the trolleys 110 and 112. The pulley axle may also act to hold the trolleys together in the illustrated orientation. Further, the trolleys 110 and 112 may be further secured in the illustrated orientation by interconnecting member 118 which may be welded or bolted as desired by the user.

It can be seen in FIG. 3 that the undersurface 120 and 122 of the trolleys 110 and 112 respectively are formed and shaped to slide on rails 124 and 126 which are part of the track means 128 similar to the track means 60 of rowing machine 12 of FIG. 2. As the lead of the block and tackle of FIG. 3 (not shown), such as lead 32 in FIG. 1, is moved away from the block and tackle 125 of FIG. 3, the first block 116 moves relative to the second block (not shown), and more particularly in the direction 130 towards the second block.

In so moving, the trolleys 110 and 112, and more particularly their slide surfaces 120 and 122, slide on the rails 124 and 126 of the track means 128. The trolleys 110 and 112 are preferably made out of a material that readily provides for a low friction sliding relationship such as teflon or nylon. Alternately, the trolleys could be made out of any desired material having sufficient structural strength to withstand the forces with a special sliding surface such as teflon or nylon adapted to form the lower surfaces 120 and 122.

It should be noted that the track means 128 is here shown to be a unitary structure preferably made of a durable and strong material. Extruded aluminum has been found to be quite suitable. The rails 124 and 126 are thus easily formed as part of the track means 128. That is, the lower portion of the track means 128 is extended a desired distance 131 to accommodate the sliding surface 120 of the trolley 110 to become the rail 124. The lower portion of the track means 128 is extended on the other side shown to become the rail 126.

It may further be noted that block 116 of the block and tackle 125 is in effect supported by the rails 124 and 126, which in turn assist in keeping the first block from sagging downward toward a support surface when positioned not on the vertical. That is, the resistance means here seen as hydraulic cylinder 102 is desirably oriented in a axial alignment with the block and tackle 125.

The block 116 is shown mounted between two trolleys 110 and 112. In the illustrated embodiment of FIG. 3, the trolleys 110 and 112 are each sized in height 132 to fit within the track means 128. That is, the track means 128 is sized in height 133 slightly larger than the height 132 of the trolleys 110 and 112. More particularly, the track means 128 may be from about one eighth of an inch to about one half an inch higher to easily accommodate the trolleys 110 and 112. Notably, the rails 124 and 126 are sized in width 131 to easily accommodate the trolleys 110 and 112 which are sized in width 135 to reside thereon. Further, the trolleys 110 and 112 are sized in length 137 to easily accommodate the pulleys 114 and the other structure shown. The trolleys 110 and 112 are spaced apart a distance 139 which is selected to fit within the track means 128 with each trolley 110 and 112 on its respective rail 124 and 126.

The resistance means of FIG. 3 may be mounted at its first end 127 to track means 128. The system of FIG. 3 is mounted or anchored by the adjustment means as described hereinafter. However, it should be understood that the track means 128 of FIG. 3 is acting as a frame means. That is, the resistance means, and in turn the resistance system of the invention, may be mounted to any acceptable structure of an exercise machine such as the track means, the frame or other comparable structure, all of which function as anchor means to anchor the resistance at one end.

Referring back to FIG. 3, the resistance system of the invention is here shown to include adjustment means to adjust the resistance. The adjustment means shown functions to adjust the piston rod 104 relative to the housing 105 of the cylinder 102. The cylinder 102 has a sleeve 134 adapted to shaft 136. Similarly, fingers 138 and 140 are mounted to the shaft 136. The fingers 138 and 140 are in turn securely adapted to a knob 142 which is positioned at the end 144 of the track means 128 for operation by the user. Indeed, a similar knob 148 is shown at the end 149 of the rowing machine 12 in FIG. 2 for easy operation by a user residing on the seat 62 and even while moving on seat 62.

Figure 4:
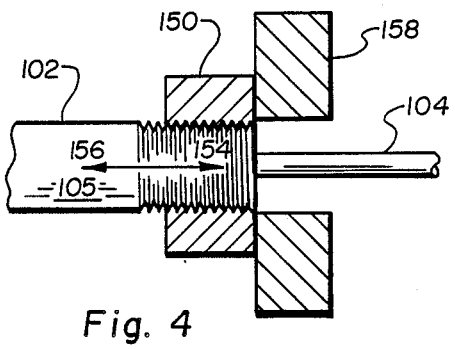
FIG. 4 is a partial cross-section of a portion of the resistance system and the adjustment means of the instant invention.

The knob 142 of FIG. 3 may be rotated in either a clockwise 146 direction or a counterclockwise 148 direction to cause the shaft 136 and sleeve 134 and in turn the housing 105 to rotate within a threaded collar 150 which is more clearly shown in FIG. 4. The fingers 138, 140 and the shaft 136 with sleeve 134 together function as a connection means to connect the knob 142 to the resistance means for transmitting adjustment information. In the illustrated version, the rotational motion is transmitted to the housing 105. With other resistance means, other structure may be desired to provide the desired adjustment.

In FIG. 4, a threaded collar 150 is in a threaded relationship to the housing 105 of the hydraulic cylinder 102 so that the housing 105 can move toward 154 or away 156 from a fixed reference which is here the tension member 158. That is, the sleeve 150 is secured by any convenient means (e.g., screws, glue, welding, or the like) to the tension member 158. As a result, operation of the knob 142 in a counterclockwise 148 or clockwise 146 direction results in relative movement between the housing 105 and the sleeve 150 to in turn cause the housing 105 to move inward 154 or away 156 from the member 158. In turn, the amount of extension of the piston rod 104 is adjusted. For other cylinders the amount of internal compression or spring tension may be adjusted, depending upon the particular cylinder selected so that the resistance is varied as desired by the user.

In FIG. 1, a spring 160 is shown interconnected between shaft 46 and shaft 52 to cause the first block 26 to move away from the second block 28, and more particularly to pull the first block 26 towards the first end 20 of the resistance means 14. As a result, after operation by the operation means in which the lead 32 is pulled away from the block and tackle, the spring 160 causes or urges the first block 26 to move toward the first end 20 of the resistance means 14 to return the resistance means. Thus, a pressure or force is exerted on the operation means both in an outward 161 and inward 163 direction (FIG. 2).

In FIG. 3, a rubber-like surgical tube 162 is interconnected between the first block 116, and more particularly the axle 108 interconnected between trolleys 110 and 112 and the track means 128 by a hook structure 164. The surgical tube operates to function the same as the spring 160 (FIG. 1) and causes or urges the first block 116 toward the first end of the resistance means and away from the second block.

It should be appreciated that even though a spring 160 and surgical tube 162 are here illustrated as return means to urge the first block away from the second block, other means may be used to achieve the same relative movement of the first block. That is, a spring could easily be positioned within the housing 105 or 40 of the respective cylinders to urge the pistons 104 and 42 respectively to move inward towards their respective housings 105 and 40.

It may be noted that the resistance system here illustrated is shown adapted for a handled rowing machine. That is, rowing machine 12 of FIG. 2 has operation means which includes handle 82 and cable 84 which is connected via pulleys positioned in the upright member 74 to be interconnected to a lead such as lead 32 with the resistance system of FIG. 1 interconnected inside the track as illustrated in FIG. 3. However, it should be appreciated that the resistance system of FIG. 1 may be interconnected on any number of other different exercise machines to provide the resistance to an operation for exercising a particular muscle group. For example, with the structure similar to a GYMPAK™, made by Diversified Products Corporation, which is well known in the art and not here illustrated, the lead 32 could easily be connected to the elevated pulley system and in turn to the handle for performing, for example, overhead pull exercises. It may also be interconnected to other structures attached to or associated with the exercise apparatus to provide resistance. It may be appreciated that the resistance system could easily be adapted into a wide variety of other machines employing weights and pulleys to provide a resistance to the user. Notably, the use of the block and tackle provides for the desired travel distance while the resistance source remains small and stationary. That is, movement of the blocks 26 and 116 results in lengthening of lead 32 by the mechanical advantage (e.g., 1" movement of block equals 8" lengthening of lead 32).

It should be recognized that the block and tackles illustrated both in FIGS. 1 and 3 both employ four tracks. As a result, the line 56 is laced four times between the two blocks to in turn provide a mechanical advance of 8 to 1. The lead 32, which is sometimes known as the hauling part of a block and tackle, is actually an extension of the line 56, which is sometimes referred to as the purchase and sometimes, as noted hereinbefore, the rope.

It is to be understood that the embodiments of the invention in essence disclosed above are merely illustrative of the principles of the invention. Reference herein to details is not intended to limit the scope of the claims, which themselves recite those features regarded as essential to the invention.

I claim:

1. A rowing exercise machine comprising:

track means for supporting a user;

support means attached to said track means to support said track means on a support surface;

seat means slidably adapted to said track means for movement thereon, said seat means being sized to support a sitting user thereon;

operation means positioned and adapted to said track means for grasping and operation by the user sitting on said seat means to perform rowing type exercises;

a resistance system adapted to said track means and to said operation means to resist movement of said operation means, said resistance system including:

resistance means for providing resistance to movement of said operation means, said resistance means having a first end secured to said track means and a second end;

block and tackle means to operate said resistance means, said block and tackle means having a first block adapted to said second end of said resistance means and a second block operably aligned with and interconnected to said first block by line means to obtain a mechanical advantage, one of said first block and second block having multiple pulleys interconnected by said line means to a pulley of the other of said first block and said second block, said line means being laced about said pulley and said multiple pulleys and having a lead extending alternatively and selectively from said first and second blocks to interconnect to said operation means for movement of said first block by said operation means, and said line means connected at only one end to said operation means.

2. The rowing exercise machine of claim 1 further including return means operatively associated with said first block to urge said first block away from said second block.

3. The rowing exercise machine of claim 1 wherein said resistance means includes adjustment means for adjusting the resistance to movement of the first block.

4. The rowing exercise machine of claim 3 wherein resistance means is a fluid cylinder of the type having a housing and a movable piston rod extending outwardly therefrom in which the force to move the piston rod increases at a preselected rate as the piston rod is moved outwardly therefrom, and wherein the adjustment means is means to move the piston rod outwardly.

5. The rowing exercise machine of claim 4 wherein said adjustment means includes knob means positioned for operation by a user sitting on said seat means and connection means interconnected to said knob means to transmit signals of adjustment from said knob means to said resistance means.

6. The rowing exercise machine of claim 4 wherein said first block and said second block are positioned to be in general axial alignment, and wherein said first block includes trolley means to maintain said first block in said general axial alignment during movement of said first block.

7. The rowing exercise machine of claim 6 wherein said operation means includes a member attached to said track means to extend upwardly therefrom with pulley means adapted thereto, a handle for grasping by the user, a cable affixed to said handle and trained about said pulley means and attached to said lead.

8. The rowing exercise machine of claim 7 wherein said trolley means includes two shoes with said first block thereinbetween and support structure to slidably support said shoes, said support structure being formed as part of said track structure.

9. The rowing exercise machine of claim 8 wherein said first and second blocks are multi-track pulleys, wherein said line means is a line laced between the first and second blocks and wherein said first and second blocks, said line and said resistance means are under said track means.

10. The rowing exercise machine of claim 9 wherein said first and second blocks each have four tracks.

11. A resistance system for exercise machines having operation means for operation by the user to perform exercises, said resistance system comprising:

resistance means mechanically associable to the structure of an exercise machine for providing resistance to movement of the operation means of the exercise machine, said resistance means having a first end securable to said structure and a second end;

block and tackle means to operate said resistance means, said block and tackle means having a first block adapted to said second end of said resistance means and a second block interconnected to said first block by line means to obtain a mechanical advantage, said line means being formed with a lead extending alternatively and selectively from said first and second blocks for interconnection to said operation means for movement of said first block by said operation means, said first block and said second block being positioned in general axial alignment, and said first block including trolley means to maintain said first block in said general axial alignment during movement of said first block said trolley means including two shoes with said first block thereinbetween and support structure associated with the structure of said exercise machine to support said shoes.

12. A resistance system for exercise machines having operation means for operation by the user to perform exercises, said resistance system comprising:

resistance means connected to the structure of an exercise machine to resist movement of the operation means of the exercise machine, said resistance means having a first end securable to said structure and a second end; and block and tackle means to operate said resistance means, said block and tackle means having a first block adapted to said second end of said resistance means and a second block in general axial alignment with and interconnected to said first block by line means to obtain a mechanical advantage, said first block and second block each having multi-track pulleys, said first block including trolley means to maintain said first block in said general axial alignment during movement of said first block, and said line means being laced about said pulleys and having a lead extending alternatively and selectively from said first and second blocks for interconnection to said operation means for movement of said first block by said operation means.

13. The resistance system of claim 12 further including return means operatively associated with said first block to urge said first block away from said second block.

14. The resistance system of claim 12 further including adjustment means directly adapted to said resistance means for adjusting the resistance to movement of the first block.

15. The resistance system of claim 14 wherein said resistance means is a fluid cylinder having a housing and a movable piston rod extending outwardly therefrom.

16. The resistance system of claim 15 wherein said fluid cylinder is of the type in which the force to move the piston rod outwardly therefrom varies at a preselected rate as the piston rod is moved outwardly therefrom. and wherein the adjustment means is a collar structure to move the piston rod outwardly.

17. The resistance system of claim 16 further including return means operatively associated with said first block to urge said first block away from said second block.

18. The resistance system of claim 12 wherein said second block is immovably adaptable to said structure and wherein said lead extends from said second block.

19. The resistance system of claim 18 wherein said first and second blocks each have four pulleys and wherein said line means is a line secured at one end to a said second block and wound sequentially about each of said pulleys of said first and second blocks.

20. A resistance system for exercise machines having operation means for operation by the user to perform exercises, said resistance system comprising:

resistance means connected to the structure of an exercise machine to resist movement of the operation means of the exercise machine, said resistance means having a first end securable to said structure and a second end;

block and tackle means to operate said resistance means, said block and tackle means having a first block adapted to said second end of said resistance means and a second block operably aligned with and interconnected to said first block by line means to obtain a mechanical advantage, said first block and second block each having at least one pulley interconnected by said line means, and said line means having a lead extending alternatively and selectively from said first and second blocks for interconnection at one end only to said operation means for movement of said first block by said operation means;

trolley means secured to said first block to maintain said first block in operable alignment with said second block; and guide means connected to the structure of said exercise machine to guide said trolley means.

21. The resistance system of claim 12 further including adjustment means directly adapted to said resistance means for adjusting the resistance to movement of the first block.

* * * * *